US011685031B2

(12) United States Patent
Balleste Izuzquiza et al.

(10) Patent No.: US 11,685,031 B2
(45) Date of Patent: Jun. 27, 2023

(54) REMOVAL TOOL FOR A FILTER INSERT OF A LIQUID FILTER

(71) Applicant: ROBERT BOSCH GMBH, Stuttgart (DE)

(72) Inventors: Elena Balleste Izuzquiza, Madrid (ES); Jose Luis Arias Arias, Madrid (ES)

(73) Assignee: ROBERT BOSCH GMBH, Stuttgart (DE)

( * ) Notice: Subject to any disclaimer, the term of this patent is extended or adjusted under 35 U.S.C. 154(b) by 794 days.

(21) Appl. No.: 16/495,751

(22) PCT Filed: Feb. 2, 2018

(86) PCT No.: PCT/EP2018/052667
§ 371 (c)(1),
(2) Date: Sep. 19, 2019

(87) PCT Pub. No.: WO2018/177631
PCT Pub. Date: Oct. 4, 2018

(65) Prior Publication Data

US 2020/0384623 A1 Dec. 10, 2020

(30) Foreign Application Priority Data

Mar. 28, 2017 (DE) ..... 10 2017 205 242.2

(51) Int. Cl.
*B25B 27/06* (2006.01)
*B25B 27/00* (2006.01)

(52) U.S. Cl.
CPC ..... *B25B 27/06* (2013.01); *B25B 27/0042* (2013.01)

(58) Field of Classification Search
CPC ..... B25B 3/00; B25B 5/067; B25B 5/082; B25B 5/101; B25B 27/00; B25B 27/06; B25B 27/0042
(Continued)

(56) References Cited

U.S. PATENT DOCUMENTS 1,506,258 A 8/1924 Shaw
6,176,469 B1 * 1/2001 Bigham ..... B66F 19/005 254/133 R
(Continued)

FOREIGN PATENT DOCUMENTS

CN 101370563 A 2/2009
CN 202225157 U 5/2012
(Continued)

OTHER PUBLICATIONS

Wang, Rui; Original Document of CN205290814; Jun. 8, 2016; p. 1-6 (Year: 2016).*
(Continued)

*Primary Examiner* — Lee D Wilson
*Assistant Examiner* — Sidney D Hohl
(74) *Attorney, Agent, or Firm* — Norton Rose Fulbright US LLP; Gerard Messina

(57) ABSTRACT

A removal tool for a filter insert of a liquid filter. The removal tool includes a first arm having a first outer side, the first outer side extending along a first axis. It furthermore includes a second arm having a second outer side, the second outer side extending along a second axis. The first arm includes a first hook, which projects from the first arm essentially transversely to the first axis. The second arm includes a second hook, which projects from the second arm essentially transversely to the second axis. The first outer side and the second outer side are connected to one another with a swivel joint having a joint axis.

15 Claims, 14 Drawing Sheets

(58) Field of Classification Search
USPC ..... 29/219.232, 242, 268
See application file for complete search history.

(56) References Cited

U.S. PATENT DOCUMENTS

| | | | | |
|---|---|---|---|---|
| 2014/0015267 | A1 | 1/2014 | Smith | |
| 2014/0327257 | A1* | 11/2014 | Vazquez | E04H 4/16 294/24 |

FOREIGN PATENT DOCUMENTS

| | | | | |
|---|---|---|---|---|
| CN | 104100615 | A | | 10/2014 |
| CN | 104582906 | A | | 4/2015 |
| CN | 205290814 | U | * | 6/2016 |
| CN | 205290814 | U | | 6/2016 |
| DE | 4415890 | | | 11/1995 |
| DE | 4415890 | A1 | | 11/1995 |
| DE | 29516238 | U1 | | 12/1995 |
| DE | 29516238 | | | 12/2015 |
| DE | 102015207565 | | | 10/2016 |
| JP | 5571865 | B1 | | 8/2014 |

OTHER PUBLICATIONS

Wang, Rui; CN205290814 Translation from Espacenet; Jun. 8, 2016; p. 1-6 (Year: 2016).*
International Search Report for PCT/EP2018/052667, dated Apr. 4, 2018.

* cited by examiner

REMOVAL TOOL FOR A FILTER INSERT OF A LIQUID FILTER

FIELD OF THE INVENTION

The present invention relates to a removal tool for a filter insert of a liquid filter. The present invention furthermore relates to a method for removing a filter insert of a liquid filter.

BACKGROUND INFORMATION

Liquid filters are referred to in the related art. Such liquid filters may be used in the automotive field, for example, to remove particles and water from fuel. Other liquid filters are configured to purify urea solutions used for DENOX systems or SCR systems, i.e., for nitrogen oxide reduction. Such liquid filters are usually made up of a housing, an inlet for the liquid, and an outlet for the purified liquid. An exchangeable filter insert may be provided in the housing of the liquid filter. This filter insert may be formed of a filter element, for example, which is attached between a first end cap and a second end cap. The first end cap may have a first opening, and the second end cap may have a second opening.

To achieve sufficient filtration of the liquid at all times, it may be necessary to exchange the filter insert after a certain duration or a mileage of the vehicle. For this purpose, either the entire liquid filter may be replaced, which, however, is cost-intensive. As an alternative, it may be provided to remove only the filter insert from the housing.

For this purpose, a so-called removal tool may be provided. Such removal tools may, for example, be enclosed with the replacement filter insert to remove the filter insert in use from the housing of the liquid filter quickly, securely and without damage.

Such a removal tool may, for example, have a one-piece configuration in the form of a flat, elongated stick (similar to an ice cream bar stick) extending along a longitudinal axis. At a distal end, the removal tool may include one or two hook(s). The removal tool may be pushed through the two openings of the first and second end caps of the filter insert for the removal process. The hooks of the removal tool latchingly engage behind an edge of the downstream opening, as viewed along the inserting direction, of the downstream end cap. The expression "downstream" shall only be understood to indicate a position with respect to a direction. When tension is now exerted on the removal tool counter to the inserting direction, the filter insert may be pulled completely out of the housing of the liquid filter. The latching engagement of the removal tool behind the opening, situated the furthest with respect to the inserting direction, of the end cap of the filter insert, situated the furthest, ensures that the complete filter insert may be removed from the housing. If the removal tool were to latchingly engage only behind the front opening, as viewed with respect to the inserting direction, there is the risk that the filter element, which may be saturated with liquid, would tear when the removal tool is pulled out and, in this way, a portion of the filter insert remain stuck in the housing.

A removal tool for a filter insert of a liquid filter is believed to be discussed in DE 10 2015 207 565 A1.

SUMMARY OF THE INVENTION

The present invention is based on the finding that a specific geometry must be present inside the filter insert when using one-piece removal tools to ensure that an insertion of the removal tool is low-friction and damage-free. As an alternative, it is necessary to configure the removal tool in a flexible or elastic manner in such a way that it is elastically deformable during mechanical contact with an inner side of the openings of the end caps or of the filter element, and further insertion is possible. These configuration conditions make a dedicated removal tool, which is configured specifically for the filter insert, necessary for each filter insert or each diameter of the openings.

Although, moreover, the inserting process may be easily implementable until the removal tool latchingly engages at the filter insert with the configuration of a flexible or elastic removal tool—at the same time, however, this increases the risk that the stability of the removal tool is not sufficient to move the filter insert out of the housing when the filter insert is being pulled out or removed. This may be the case, for example, when the filter insert is seated particularly firmly. In such a case, it is possible that the removal tool deforms due to its elasticity and is not sufficiently stable to move the filter insert out of the housing. As a result, multiple attempts may be necessary to complete the removal of the filter insert from the housing. This also increases the risk of damaging the filter element during the re-insertion of the removal tool, whereby, in turn, the risk may increase that it is not possible to completely remove the filter insert from the housing.

In the case of a conventional removal tool, the secure insertion of the removal tool until it latchingly engages behind the opening of the end cap may also be problematic. During the manufacturing process of the filter insert, it is possible that the diameter of the opening is reduced by adhesive material or molten a compound when the end cap is adhesively bonded to the filter element or the end cap is welded to the filter element. In such a case, it may become difficult to reliably move the removal tool through the opening in such a way that the hooks of the removal tool engage behind the edge of the opening.

A need may therefore exist to provide a removal tool which is equally suitable for removing various filter inserts. At the same time, the removal tool is to be configured in such a way that the risk of damaging the filter element of the filter insert during the insertion of the removal tool through the filter insert may be low. Finally, the removal tool is to be configured in such a way that, even with larger tolerances of the opening diameter as a consequence of production processes, secure feeding through the opening of the end cap is reliably made possible without major energy expenditure, and subsequently secure latching engagement behind the edge of the opening of the end cap is made possible. Finally, the removal tool is to be easy and cost-effective to manufacture.

This need may be covered by the subject matter of the present invention according to the descriptions herein. Advantageous specific embodiments of the present invention are described in the further descriptions herein.

According to a first aspect of the present invention, a removal tool for a filter insert of a liquid filter is provided. The removal tool includes a first arm having a first outer side, the first outer side extending along a first axis. The removal tool furthermore includes a second arm having a second outer side, the second outer side extending along a second axis. The first arm includes a first hook, which essentially projects from the first arm transversely to the first axis. The second arm includes a second hook, which essentially projects from the second arm transversely to the second axis. It is provided that the first outer side and the second outer side are connected to one another so as to be rotatable relative to one another with the aid of a swivel joint, which has a joint axis. The swivel joint is thus situated or provided on the two outer sides in such a way that the two arms are rotatable relative to one another. The two arms may thus be rotated or pivoted about the swivel joint with its rotation axis.

The term "include" here shall be understood to be synonymous to the term "have".

The expression "essentially transversely" is understood to mean a direction perpendicular to the first axis or to the second axis, it being possible for the direction to deviate from the perpendicular by up to +/−20°.

In other words: the removal tool is configured in the form of two door panels connected to one another with the aid of a joint and rotatable relative to one another. In this way, it is possible in a simple and reliable manner to vary the distance between the first hook and the second hook. During the insertion of the removal tool, the distance between the first hook and the second hook may thus be selected to be small, or the projected area of the removal tool onto a plane perpendicular to an inserting direction into the filter insert may be reliably smaller than the projected area of a channel provided, e.g., inside the filter insert, in particular the projected area of the removal tool may, e.g., always be located on the inside of the projected area of such a channel. After completion of the inserting process, i.e., when the two hooks have arrived behind the rear opening, as viewed along the inserting direction, the distance between the two hooks may be increased, by a rotation of the first arm relative to the second arm about the swivel joint, in such a way that the two hooks are able to engage behind an edge of the opening. The distance between the two hooks may then be configured in such a way that "slipping" off the edge of the opening is no longer possible.

The two hooks are suitable for engaging behind the edge of an opening of one of the end caps, in particular of the opening of the filter insert situated downstream with respect to the inserting direction. In the context of the present application, the term "downstream" or "upstream" shall only be understood to mean a relative position with respect to a defined direction. This is not a flow direction of a liquid, unless explicitly stated.

The provided removal tool may advantageously be manufactured easily and cost-effectively. Due to the variable distance of the two hooks from one another, it is advantageously suitable for the use for the removal or extraction of filter inserts of a wide variety of configurations or having different diameters of the openings of the end caps. In other words: the provided removal tool may be used universally for different filter inserts.

Furthermore, in the case of variations of the diameter of the openings of the end caps as a consequence of production tolerances, the removal tool may still be pushed through the filter insert without difficulty and easily, i.e., without major energy expenditure, and be adjusted, in the inserted state, in such a way that the two hooks are reliably and securely situated behind the edge of the opening, and a secure extraction or a secure removal of the filter insert from the housing of the liquid filter is made possible.

Finally, the removal tool or the first arm and the second arm may be configured to have shape stability. A particular elasticity of the material or of the shape of the removal tool is not necessary. The reason is that the distance between the hooks may be set for the inserting process in such a way that the hooks may be pushed through the filter insert without difficulty, in particular without mechanical contact with the inside of the filter element or the edge of one of the openings of the end caps. As a result of a shape-stable configuration of the two arms, the removal process becomes particularly simple and reliable. The reason is that an accidental distortion of the removal tool is not to be expected due to the shape stability, even if higher pull-out forces should be necessary. In this way, it is advantageously ensured that the filter insert may already be extracted or removed from the housing in one piece without damage and reliably in the first attempt.

One refinement provides that the joint axis of the swivel joint extends in parallel or essentially in parallel to the first axis. The joint axis may even coincide with the first axis. It is also possible for the joint axis to be aligned in parallel or essentially in parallel to the second axis.

This advantageously results in a particularly simple manufacture of the removal tool. Furthermore, in this way, it is advantageously achieved that the two hooks may be rotated in a shared plane during the rotation of the first arm relative to the second arm, whereby the contact surface on the edge of the opening of the cap is increased and thus the pressure on individual points of the edge is decreased when pulling out the filter insert.

In one refinement, it is provided that the removal tool is manufactured in one piece. This advantageously results in a particularly simple and cost-effective manufacture. Moreover, it is thus ensured that a faulty assembly of the removal tool does not occur after the production process for the first arm and the second arm. For example, the removal tool may be manufactured from metal or from plastic in a single injection molding process.

In one refinement, it is provided that the swivel joint is configured as an integral joint or as a hinge. In this way, it is advantageously achieved that the two arms are always captively connected to one another. It is possible that the swivel joint is made up of multiple joint segments. For example, the swivel joint may be made up of two, three, four or even more sub-joints. The joint axes of the individual swivel joints may be situated collinearly with respect to one another, so that only a single rotation axis is implemented. This corresponds to the suspension of a door on multiple hinges.

An integral joint shall be understood to mean a strap hinge including no mechanical parts. An integral joint may, for example, be configured as a flexible, thin-walled joint groove between two parts to be connected, in this case between the first arm and the second arm.

As a result of the use of an integral joint or a hinge, a particularly cost-effective and rapid assembly may be achieved. In addition, individual parts may advantageously be saved. Particularly advantageously, the removal tool, together with the integral joint or the hinge, may be manufactured as an injection molded part.

It may be provided that the removal tool is settable into an insertion state and into a removal state different from the insertion state by a rotation of the arms relative to one another about the swivel joint. In the insertion state, the first hook and the second hook essentially point in the same direction. In the insertion state, the first hook has a first distance from the rotation axis. In the removal state, the first hook and the second hook have a second distance from one another. The first distance is smaller than the second distance.

The expression "essentially in the same direction" shall be understood to mean that the extension directions of the two hooks may enclose an angle of up to +/−20° with one another.

For example, the first distance may be smaller than a first diameter of the first opening of the first end cap of the filter insert. For example, the second distance is greater than the first diameter of the first opening of the first end cap of the filter insert.

In the same way, a first distance of the second hook from the rotation axis may be smaller than a first diameter of the first opening of the first end cap of the filter insert.

For example, the first distance is no more than 75%, advantageously no more than 70.7% (1/SQRT(2)), further advantageously no more than 60%, and most particularly advantageously no more than 50% of the second distance. The first distance and the second distance are measured, for example, from the free end of the first hook to the free end of the second hook, i.e., from the respective outermost points of the respective hooks.

In this way, it is advantageously achieved that the removal tool may be fed with its two hooks into the filter insert or through the openings of the end cap of the filter insert with little energy expenditure, and which may be without mechanical contact. At the same time, it is thus achieved that, in the removal state, the two hooks end up contacting reliably behind an edge of the first opening of the first end cap of the filter insert or engage behind it, and in this way, a removal of the filter insert is reliably enabled. The first end cap is situated downstream from the second end cap of the filter insert, as viewed with respect to the inserting direction of the removal tool.

It may be provided that, in the removal state, the first hook and the second hook point outwardly away from one another (180°). The expression "point outwardly" shall be understood to mean a direction which is directed away from the body of the respective arm. As an alternative, it may be provided that, in the removal state, the two hooks enclose an angular value between 70° and 110° between one another with respect to their extension direction, particularly advantageously an angular value between 85° and 95°.

It may be provided that the first hook is situated on a first hook end of the first arm which is situated opposite the first operating end. Furthermore, it may be provided that the second hook is situated on a second hook end of the second arm which is situated opposite the second operating end. The first hook end and the second hook end form the distal ends of the respective arm.

One refinement provides that the first arm or the second arm includes at least one stop for the other arm, so that a rotation of the two arms about the swivel joint relative to one another by more than 100° is prevented.

It shall be understood that, when, for example, the first arm includes the stop, the second arm strikes against the stop during a relative rotation about the maximum angle.

Conversely, e.g., the first arm may strike against the stop of the second arm should the first arm be rotated or pivoted by the maximum rotation angle (less than 100°).

By providing the at least one stop, it is advantageously achieved that a technician is able to handle the removal tool reliably and securely. In the event of limited visual conditions, it may be ensured by the stop that the technician has either reliably transferred the removal tool into the removal state when the stop is reached, or has moved the removal tool into the insertion state. Furthermore, an overextension of the swivel joint, and thus possible damage to the swivel joint, is thus advantageously prevented.

It may be provided that the first operating end of the first arm has a channel-like first operating opening.

As an alternative or in addition, it may be provided that the second operating end of the second arm has a channel-like second operating opening.

It is possible that, for example, the two operating openings are aligned with one another in the removal state.

By providing the operating openings or at least one operating opening, the extraction process or removal process may be considerably facilitated for an operator or user of the removal tool. The reason is that it is possible that the operator is able to push his or her finger or a tool, such as a screwdriver or a wrench, through the first operating opening and/or the second operating opening, so that a force may be exerted on the removal tool over a larger area during the removal process.

One refinement provides that the first arm, on an end situated opposite the first hook, includes a third hook, which projects from the first arm essentially transversely to the first axis. On an end situated opposite the second hook, the second arm includes a fourth hook, which projects from the second arm essentially transversely to the second axis. The third hook has a greater length than the first hook, as viewed transversely to the first axis. As an alternative or in addition, the fourth hook has a greater length than the second hook, as viewed transversely to the second axis.

The length is measured in each case from the free end of the respective hook to the swivel joint.

In this way, it is advantageously achieved that the removal tool may be used for different filter inserts. The end of the removal tool on which the first and second hooks are situated may thus be used for filter inserts which have a small insertion channel or whose openings in the first and second end caps have a relatively small diameter. In contrast, the end of the removal tool which includes the third and fourth hooks may then be used when filter inserts have to be removed which have a comparatively larger channel diameter or a larger diameter of the openings in the first end cap and/or in the second end cap. The reason is that, in the case of the latter filter elements, it could be possible that the end including the first and second hooks is not able to engage behind the edge of the first opening of the first end cap in the removal state since the length of the first and second hooks is too short.

In this way, i.e., using two hooks of different lengths on the two different ends of the removal tool, a removal tool may be provided which is universally usable particularly well.

In one refinement, it may be provided that a securing element is situated on the first arm, a mating element complementary to the securing element being situated on the second arm. In the removal state, the securing element is coupled to the mating element.

In the removal state, the securing element and the mating element may, for example, be coupled to one another in a force-fit or frictionally engaged or form-locked manner.

By providing the securing element and the mating element, it is advantageously achieved that, in the removal state, an inadvertent slipping of the hook from the edge of the first opening of the first end cap is avoided. Furthermore, as a result of the coupling of the first arm to the second arm as a consequence of the securing element and the mating element, the stability is improved so that the removal tool overall has a stiffer configuration. In this way, a reliable and secure removal of the filter insert from the liquid filter is possible.

In one refinement, it may be provided, for example, that the securing element is configured as a pin, and the mating element is configured as a groove in which the pin is accommodated in the removal state. As an alternative, the mating element may be configured as a pin, and the securing element may be configured as a groove in which the pin is accommodated in the removal state. As a result of this refinement, it is advantageously achieved that a particularly simple and stable coupling between the first arm and the second arm may be achieved in the removal state.

It shall be understood that it is also possible for more than a single securing element-mating element pair to be provided on the removal tool.

According to a second aspect of the present invention, a method for removing a filter insert of a liquid filter is provided. In the mounted state, the liquid filter includes a housing and at least one liquid inlet and at least one liquid outlet. Furthermore, the liquid filter includes a filter insert, which is inserted, e.g., in the housing. The filter insert includes a filter element extending along a longitudinal axis and a first and a second end cap. The filter element may be folded in a star-shaped manner, for example, or be configured as a wound filter element. Other filter elements are also possible. The filter element is situated between the first end cap and the second end cap, as viewed along the longitudinal axis. The first end cap has a first channel-like opening, and the second end cap has a second channel-like opening. The filter insert may have a hollow-cylindrical configuration, for example. The method includes the following steps:

- a first step: providing a removal tool according to the above description;
- a second step: setting the removal tool into an insertion state, the first hook and the second hook in the insertion state having a first distance from the swivel joint which is smaller than a first diameter of the first opening and smaller than a second diameter of the second opening;
- a third step: inserting the removal tool into the filter insert along an inserting direction in such a way that the hooks of the removal tool are at least fed through the first opening, which may be fed completely through the second opening and through the first opening;
- a fourth step: setting the removal tool into a removal state by rotating the two arms of the removal tool relative to one another about the swivel joint, the first hook and the second hook in the removal state engaging behind an edge of the first opening of the first end cap; and
- a fifth step: displacing the removal tool counter to the inserting direction so that the filter insert is removed from the housing together with the removal tool.

As a result of the provided method, a particularly simple insertion of the removal tool through the filter insert is made possible. Moreover, the same removal tool may be used for different filter inserts having openings of different sizes. Finally, the method offers the advantage that, after the removal tool has been fed through the two openings, it may be ensured in a simple manner that the two hooks reliably and securely engage behind the edge of the first opening and, in this way, the filter insert may be reliably removed or extracted in a single piece or "entirely" from the housing of the liquid filter.

Further features and advantages of the present invention will become apparent to those skilled in the art from the following description of exemplary specific embodiments, which, however, should not be interpreted as limiting the present invention, with reference to the accompanying drawings.

DETAILED DESCRIPTION

Figure 1A:
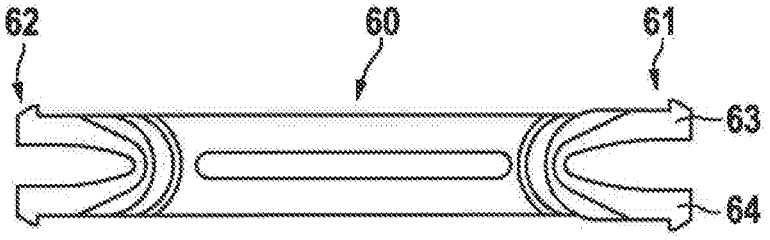
FIG. 1a ( Related Art )
FIGS. 1*a* through 1*e* show various representations of a removal tool and its use from the related art.

FIG. 1*a* shows a removal tool 60 from the related art. Removal tool 60 is configured in one piece in the form of an ice cream bar stick or a spatula. In other words: removal tool 60 has a flat, elongated extension. On a front distal end 61, removal tool 60 includes a first hook 63 and a second hook 64, which are configured in the form of two fork tines. A similar structure is also situated on the second distal end 62 of removal tool 60. Removal tool 60, in its center section, has a recess between first end 61 and second end 62, so that it may be shape-elastic and bendable.

Figure 1B:
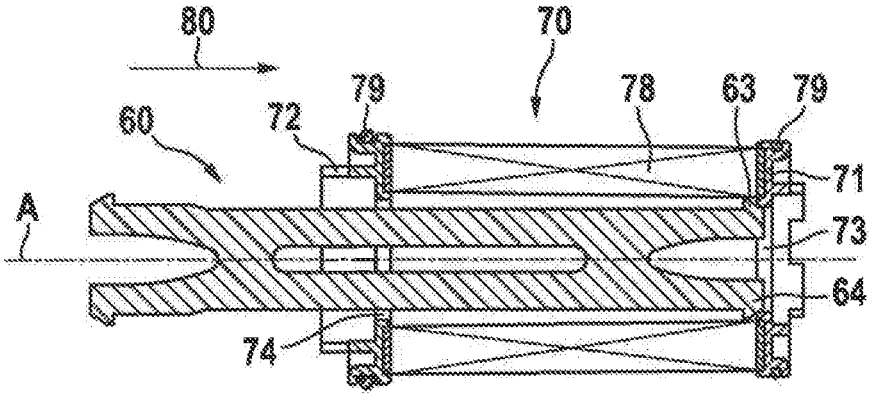
FIG. 1b ( Related Art )

FIG. 1*b* shows removal tool 60 from the related art during the insertion along an inserting direction 80 into a filter insert 70. Filter insert 70 has a hollow-cylindrical shape and extends along a longitudinal axis A. Longitudinal axis A defines an axial direction. A radial direction, which extends perpendicularly to longitudinal axis A, is to be distinguished therefrom. Filter insert 70 includes a first end cap 71 having a first opening 73 and a second end cap 72 having a second opening 74.

A filter element 78 is attached in a fluid-tight manner between the two end caps 71, 72. Filter element 78 also has a hollow-cylindrical shape, so that removal tool 60 may initially be pushed along longitudinal axis A in insertion direction 80 through second opening 74, then pass the hollow interior of filter element 78, and finally be pushed through first opening 73 of first end cap 71. The distance between the two hooks 63, 64 of the removal tool is greater than the diameters of first opening 73 and of second opening 74. Due to the fork-shaped configuration of first end 61 of removal tool 60, hooks 63, 64 may be elastically reversible inwardly deflected, in the manner of snap-fit hooks when striking on the edge of the respective opening 73, 74, and, after passing the respective opening 73, 74, may spring back outwardly.

Figure 1C:
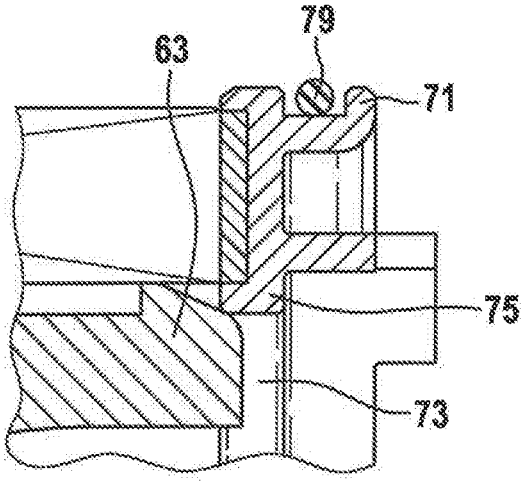
FIG. 1c ( Related Art )

FIG. 1*c* shows an enlarged section from FIG. 1*b* in a state in which first hook 63 rests directly against edge 75 of first opening 73, shortly before passing first opening 73 during the inserting process.

Filter insert 70 moreover also includes a sealing arrangement/apparatus 79, for example in the form of O-rings 79, which are each situated on a radial outer side of first end cap 71 and of second end cap 72, and enable sealing with respect to a housing 93 of a liquid filter 90.

Figure 1D:
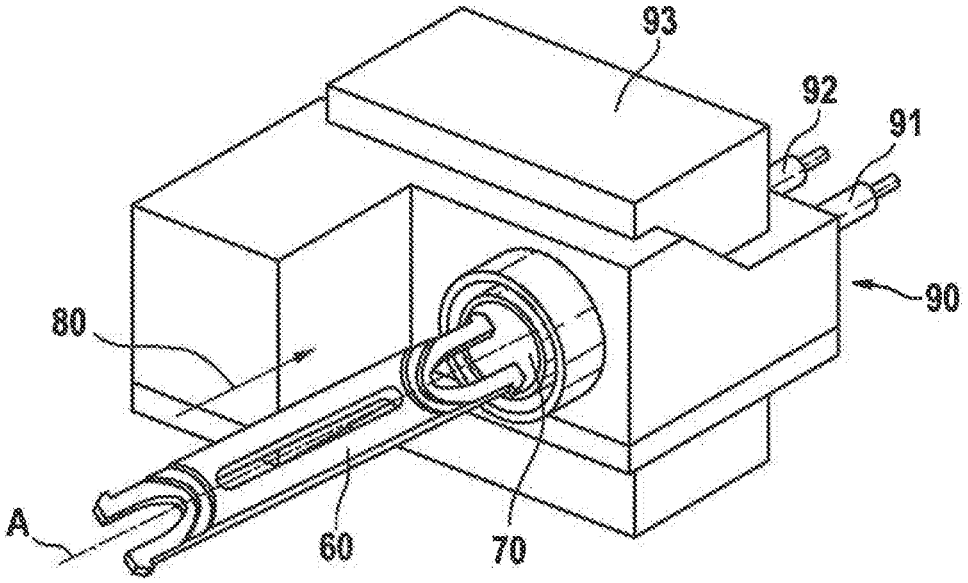
FIG. 1d ( Related Art )

FIG. 1*d* shows a liquid filter 90 including a housing 93 and a liquid inlet 91 and a liquid outlet 92. Filter insert 70 is mounted in housing 93. Usually, filter insert 70 is covered by a cover in a fluid-tight manner. In the illustrated figure, however, filter insert 70 is to be removed from housing 93 with the aid of removal tool 60 from the related art. The state in which removal tool 60 is about to be inserted into filter insert 70 along inserting direction 80 is shown.

Figure 1E:
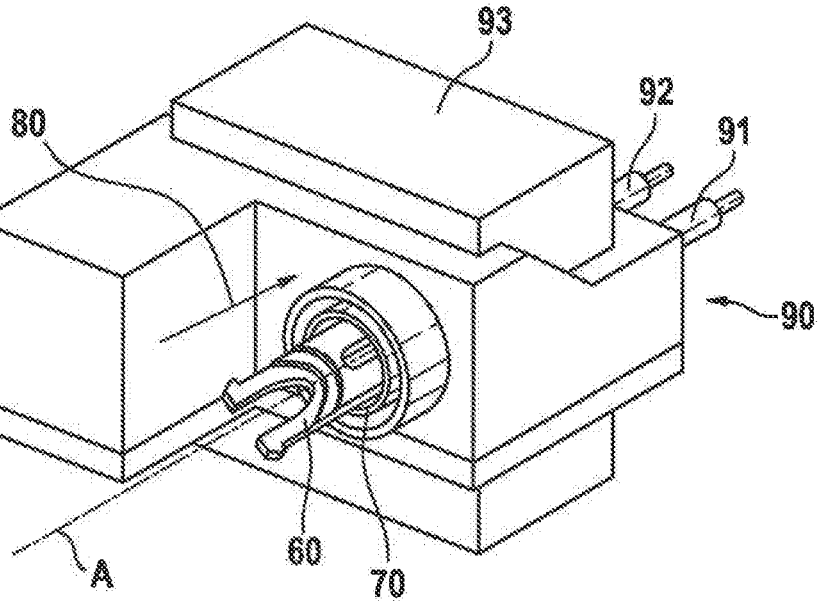
FIG. 1e ( Related Art )

FIG. 1*e* shows liquid filter 90 from FIG. 1*d*, removal tool 60 now being inserted into filter insert 70 in such a way that the two hooks (not shown) engage behind edge 75 of first opening 73 (not shown) of filter insert 70. By a displacement of removal tool 60 counter to inserting direction 80, removal tool 60, together with filter insert 70, may now be removed from liquid filter 90.

Liquid filter 90 may, for example, be a fuel filter, e.g., for oil, diesel or gasoline. It is also possible for liquid filter 90 to be provided as a filter for filtering urea solution in a DENOX system or SCR (selective catalytic reduction) system. Other uses of the liquid filter are also conceivable.

Figure 2A:
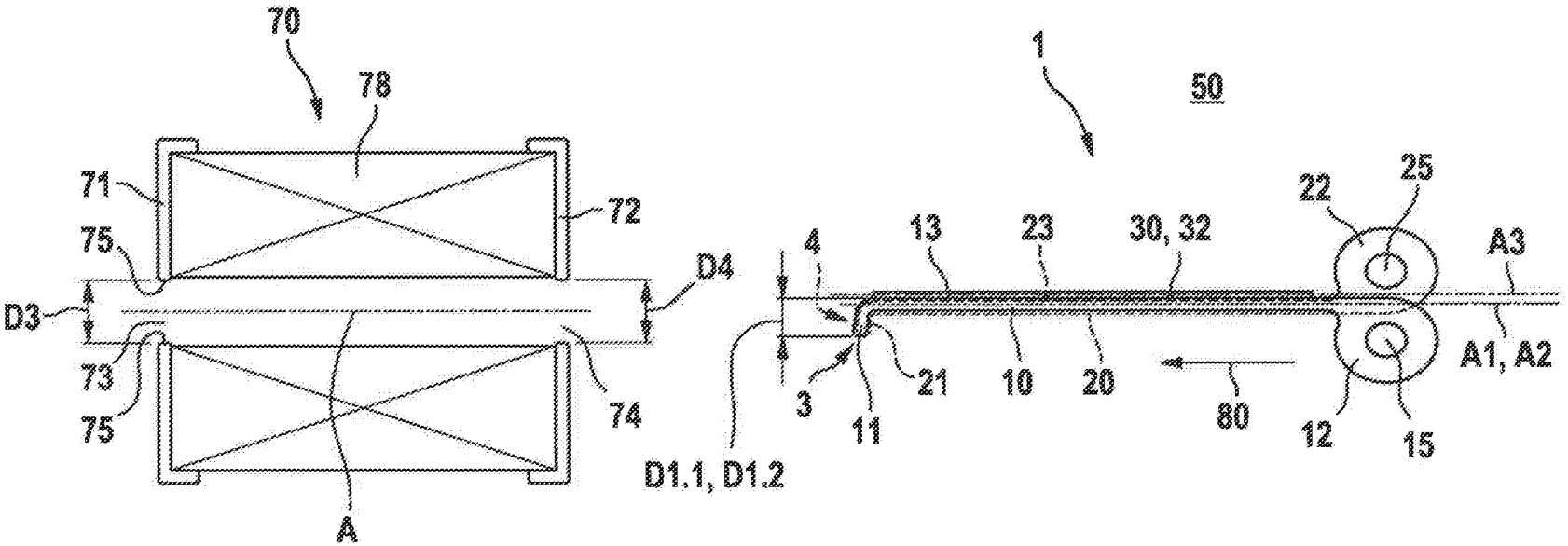
FIGS. 2*a* through 2*c* show schematic representations of a removal tool according to the present invention and its use in the insertion state and in the removal state.

FIG. 2*a* schematically shows a removal tool 1 of the present invention and a filter insert 70. Identical reference numerals denote identical functional elements.

First opening 73 of first end cap 71 of filter insert 70 has a first diameter D3. Second opening 74 of second end cap 72 has a second diameter D4.

Removal tool 1 is shown in an insertion state 50. Removal tool 1 includes a first arm 10 having a first outer side 13, first outer side 13 extending along a first axis A1. Removal tool 1 moreover includes a second arm 20 having a second outer side 23, second outer side 23 extending along a second axis A2. The second arm is only drawn in a dotted line in the figure since, in insertion state 50, it is situated behind first arm 10. First arm 10 includes a first hook 11, which projects essentially transversely to first axis A1, i.e., approximately perpendicularly (+/−20° relative to the perpendicular), from first arm 10 and is suitable for engaging behind edge 75 of first opening 73 of first end cap 71 of filter insert 70. The second arm includes a second hook 21 (situated behind first arm 11 in the figure), which projects essentially transversely to second axis A2 from second arm 20 and is suitable for engaging behind edge 75 of first opening 73 of first end cap 71 of filter insert 70.

First hook 11 is situated on a first hook end 3 of first arm 10, and second hook 21 is situated on a second hook end 4 of second arm 20. Both hook ends 3, 4 may, for example, be the distal ends of the respective arm 10, 20.

First outer side 13 of first arm 10 and second outer side 23 of second arm 20 are connected to one another so as to be rotatable relative to one another with the aid of a swivel joint 30, 32 having a joint axis A3. Swivel joint 30 may, for example, be configured as an integral joint 32, e.g., as a flexible, thin-walled joint groove between the two parts to be connected to one another, namely first arm 10 and second arm 20. Swivel joint 30 may also be configured as a hinge.

On first arm 10, at its end situated opposite first hook end 3, removal tool 1 has a first operating end 12, which has a channel-like first operating opening 15 through which, for example, a screwdriver or a finger of an operator or of a user may be pushed. At its end situated opposite second hook end 4, second arm 20 has a second operating end 22, second operating end 22 having a second channel-like operating opening 25 through which also a screwdriver or a finger may be pushed. Removal tool 1 may be configured in such a way that the two operating openings 15, 25 are aligned in a removal state 52 (FIG. 2*c*) of removal tool 1.

First hook 11 has a first distance D1.1 between its free end and the rotation axis. Accordingly, second hook 21 has a first distance D1.2 between its free end and the rotation axis. First distance D1.1 or D1.2 of first hook 11 or of second hook 21 is measured in each case from the outer ends of the respective hook to the rotation axis. In shown insertion state 50, first hook 11 and second hook 21 essentially have the same direction, i.e., in directions which maximally enclose an angle of +/−20° with respect to one another. The first distance of first hook D1.1 is smaller than a first diameter D3 of first opening 73 of first end cap 71 of the filter insert. In the same manner, first distance D1.2 of second hook 21 is also smaller than first diameter D3 of first opening 73 of first end cap 71 of the filter insert.

Figure 2B:
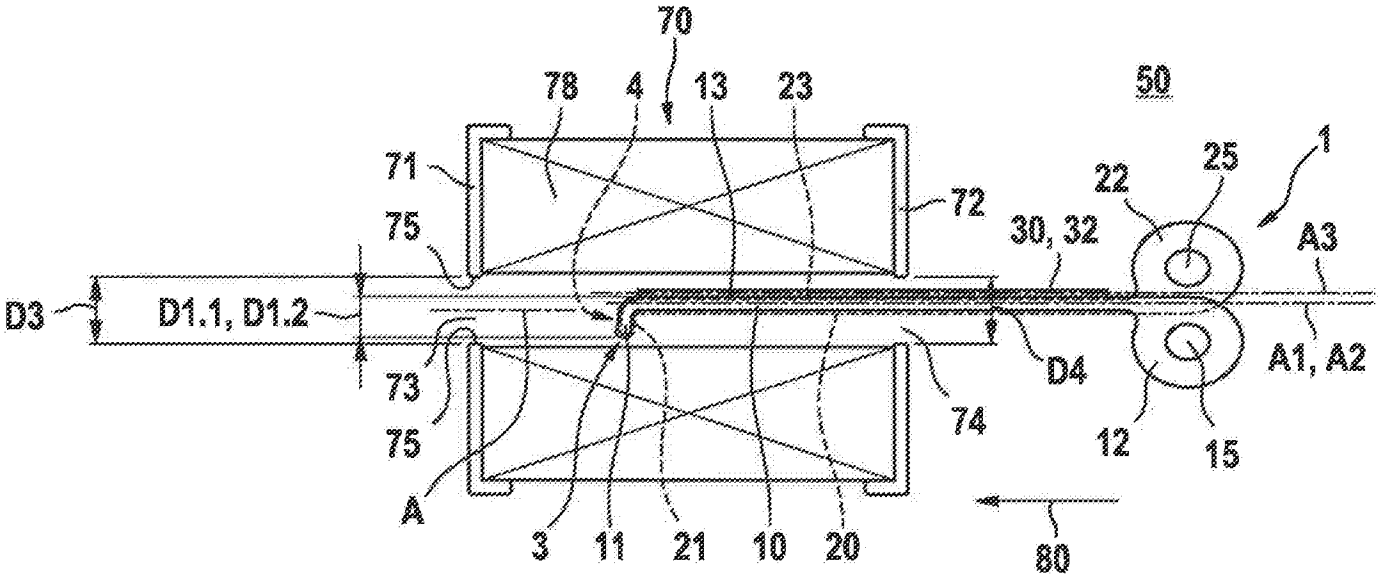

FIG. 2*b* continues to show removal tool 1 in insertion state 50, removal tool 1 now being inserted through second opening 74 into the hollow-cylindrical recess of filter element 78. As a result of first distance D1.1, D1.2 of the two hooks 11, 21 being smaller than second diameter D4 of second opening 74 of second end cap 72, the insertion of removal tool 1 may take place essentially without mechanical contact with parts of the filter insert, and thus without major energy expenditure and without damage. First distance D1.1, D1.2 of the two hooks 11, 21 may be also smaller than the diameter of the recess of filter element 78 so that the inserting process of removal tool 1 through filter element 78 may take place without damage to filter element 78. This may, in particular, be important since filter element 78 may still be saturated with liquid during the removal process, whereby the intrinsic stability of filter element 78 may be reduced. In particular when filter element 78 is damaged, filter insert 70 may be torn apart.

Figure 2C:
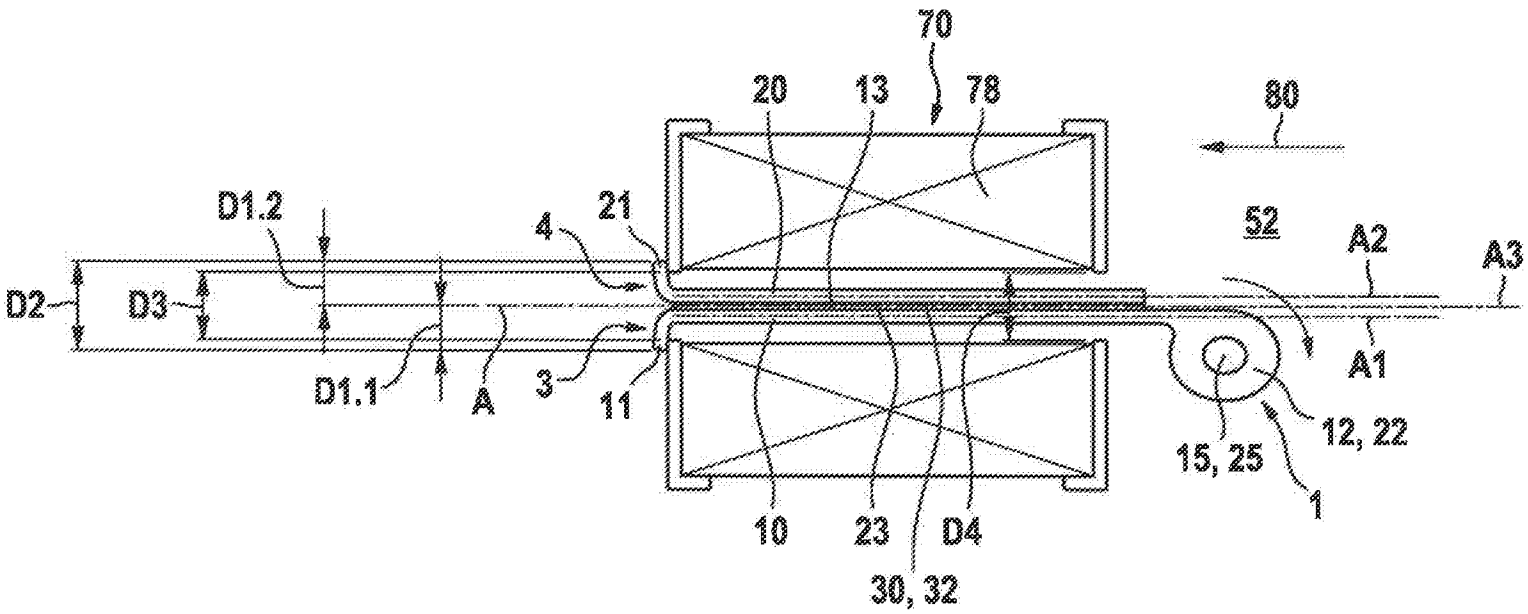

FIG. 2*c* shows removal tool 1 in removal state 52. For this purpose, removal tool 1 has now also been fed through first opening 73. Since first distance D1.1, D1.2 of the two hooks 11, 21 in insertion state 50 is also smaller than first diameter D3, the two hooks 11, 21 may also be fed through first opening 73 of first end cap 71 without difficulty.

To adjust removal tool 1 now into removal state 52, the two operating ends 12, 22 are turned about swivel joint 30, 32 (see arrow). As a result, first arm 10 turns relative to second arm 20 about swivel joint 30, 32, and the two hooks 11, 21 pivot apart. The two hooks 11, 21 engage behind edge 75 of first opening 73 in the process. In removal state 52, the two hooks 11, 21 now have a second distance D2 from one another, which is greater than first diameter D3 of first opening 73. In removal state 52, removal tool 1 may now be displaced, together with complete filter insert 70, out of housing 93 of liquid filter 90 by a displacement of removal tool 1 counter to inserting direction 80.

The provided removal tool 1 has the advantage that a damage-free, rapid and reliable insertion of removal tool 1 through the two openings 73, 74 of the two end caps 71, 72 is possible with little energy expenditure. In this way, removal state 52 may be set in a simple manner, in which a reliable removal of filter insert 70 with the aid of removal tool 1 may be achieved. The reason is that the two hooks 11, 21 engage behind edge 75 of first opening 73 of first end cap 71 in a secure, broad-based and reliable manner.

Figure 3A:
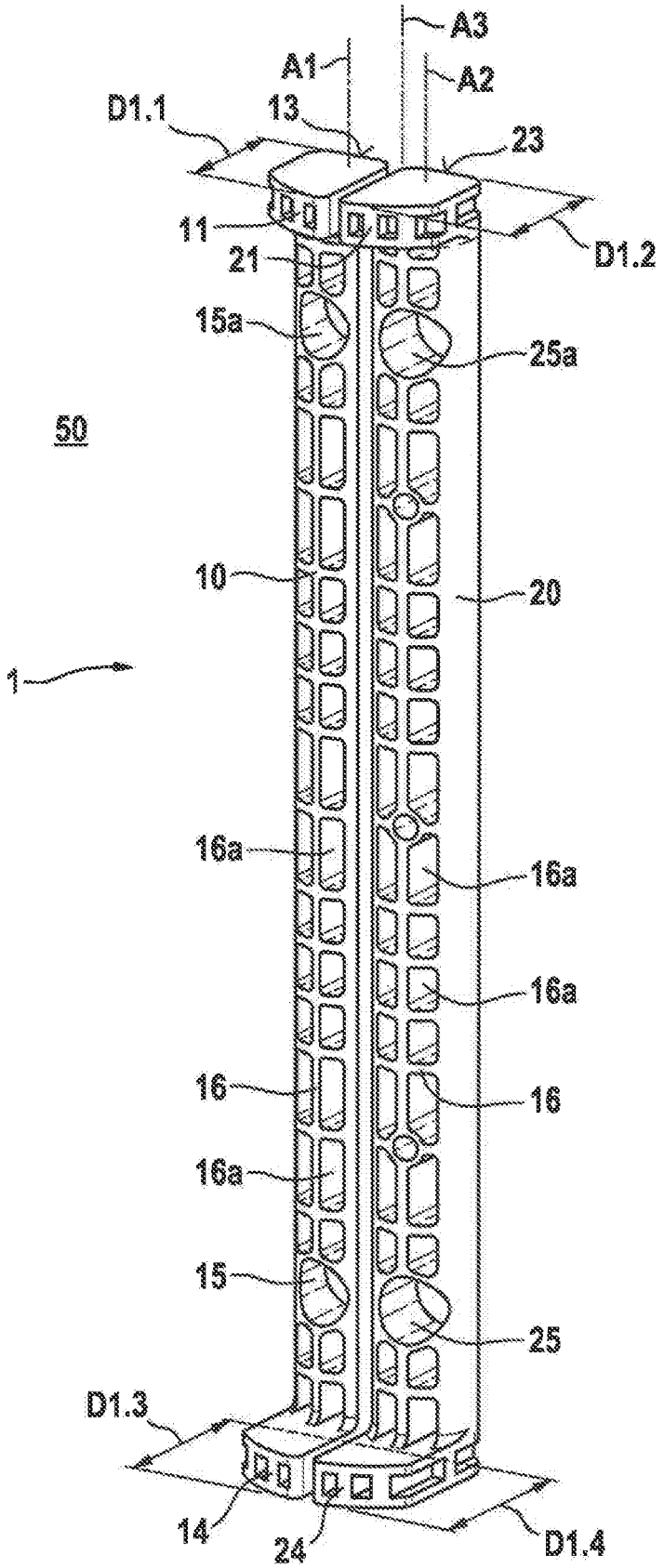
FIGS. 3*a*, 3*b* show the front and rear views of an exemplary embodiment of a removal tool in the insertion state.

FIG. 3*a* shows a specific embodiment of removal tool 1 in a front view. The shown removal tool 1 includes respective hooks on its two distal ends of the two arms 10, 20. A first hook 11 and a third hook 14 are thus apparent on first arm 10. Furthermore, a second hook 21 and a fourth hook 24 are apparent on second arm 20. Third hook 14 is longer than first hook 11. This is illustrated by distances D1.1 and D1.3. Fourth hook 24 has a first length, which corresponds to first distance D1.4 of the fourth hook from rotation axis A3 and which is greater than the first length (corresponding to first distance D1.2) of second hook 21.

Like second arm 20, first arm 10 has a rod-shaped configuration and has a plurality of perforations or recesses 16*a* between which webs 16 extend. In this way, removal tool 1 is particularly lightweight and nonetheless stable.

Removal tool 1 is shown in insertion state 50. On the end of the removal tool situated furthest from first hook 11 and second hook 21, a first operating opening 15 and a second operating opening 25 are apparent. If first arm 10 is now pivoted 180° relative to second arm 20 about rotation axis A3 of swivel joint 30, which is not apparent in the shown illustration, first operating opening 15, together with second operating opening 25, forms a channel-like through-opening through which, for example, a screwdriver may be pushed to achieve a better energy distribution for an operator or a technician during the pull-out process.

In the same manner, a first operating opening 15*a* and a second operating opening 25*a* are provided on the end of removal tool 1 situated opposite third hook 14 and fourth hook 24. If removal tool 1 is thus used in a configuration in which third hook 14 and fourth hook 24 are inserted first into the filter insert, first operating opening 15*a* and second operating opening 25*a* may be used in removal state 52 for inserting a screwdriver.

It is clearly apparent in the shown figure that first outer side 13 of first arm 10 and second outer side 23 of second arm 20 face one another.

Figure 3B:
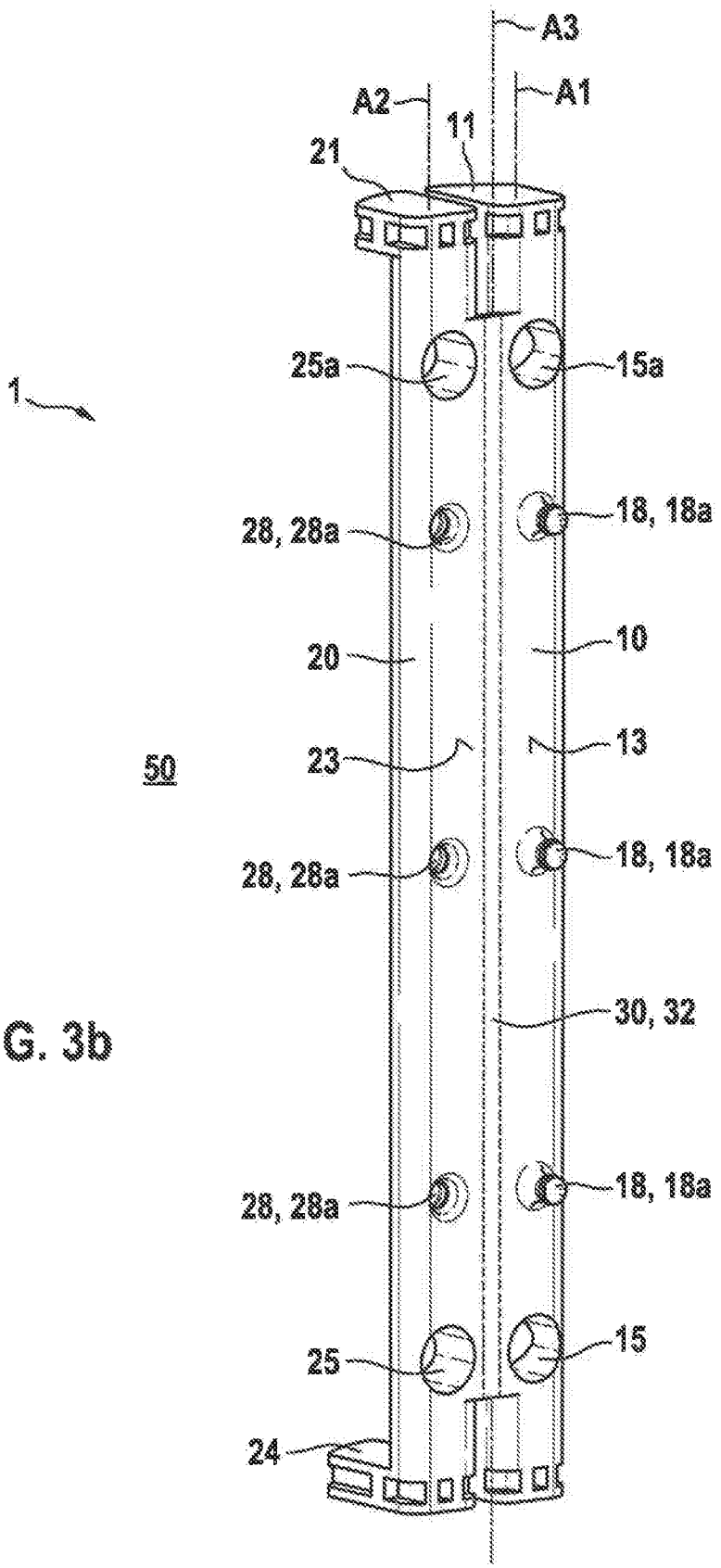

FIG. 3*b* shows removal tool 1 from FIG. 3*a* in a rear view. Swivel joint 30 is clearly apparent, which is configured as an integral joint 32 here.

Furthermore, three securing elements 18, 18*a* on first arm 10 are shown in the illustrated rear view, which are configured as pins 18*a*. On the rear side of second arm 20, mating elements 28 corresponding to securing elements 18 are situated, which are shown in the form of blind boreholes or grooves 28*a* here. During a rotation of first arm 10 relative to second arm 20 by approximately 180°, securing elements 18, 18*a* are able to engage in grooves 28*a* of second arm 20. In this way, a particularly stable coupling between first arm 10 and second arm 20 is achieved since, without this coupling, first arm 10 is only connected to second arm 20 with the aid of swivel joint 30. By providing securing elements 18 and the corresponding mating elements 28, removal tool 1 is mechanically stabilized during the removal process.

Figure 4B:
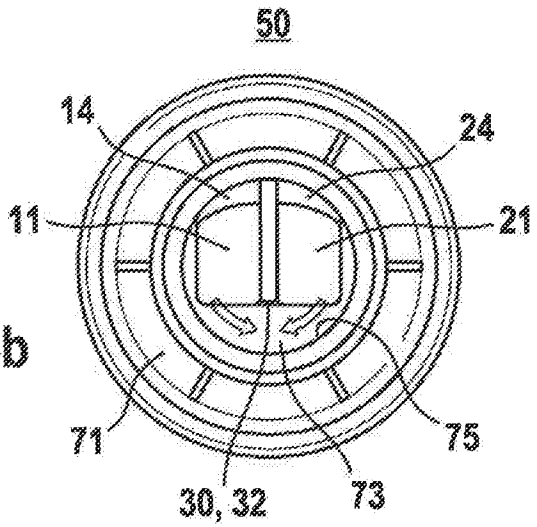
FIGS. 4*a* through 4*d* show schematic cross sections and top views of the removal tool from FIGS. 3*a*, 3*b* in the insertion state (FIGS. 4*a*, 4*b*) and in the removal state (FIGS. 4*c*, 4*d*).
Figure 4A:
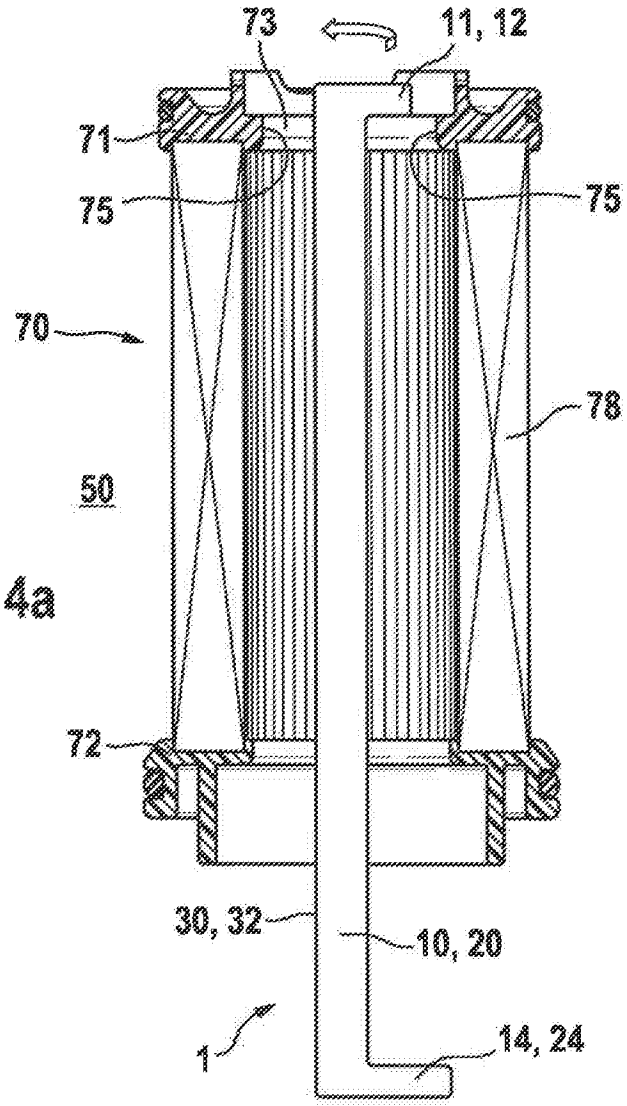

FIG. 4*a* schematically shows a cross section through a filter insert 70 into which removal tool 1 from FIGS. 3*a* and 3*b* has been inserted. Removal tool 1 is still in insertion state 50.

FIG. 4*b* shows a top view onto first hook 11 and second hook 21 of removal tool 1 from FIG. 4*a*. It is apparent that the two hooks 11, 21 do not yet engage behind edge 75 of first opening 73 of first end cap 71 of filter insert 70. Since third hook 14 and fourth hook 24 are longer than first and second hooks 11, 21 in the illustrated, sole exemplary embodiment, third and fourth hooks 14, 24 may be seen protruding beyond first and second hooks 11, 21 in the shown top view onto first end cap 71.

Figure 4D:
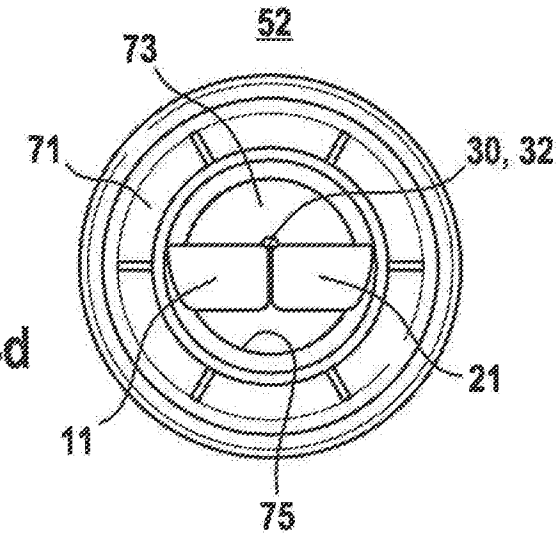
Figure 4C:
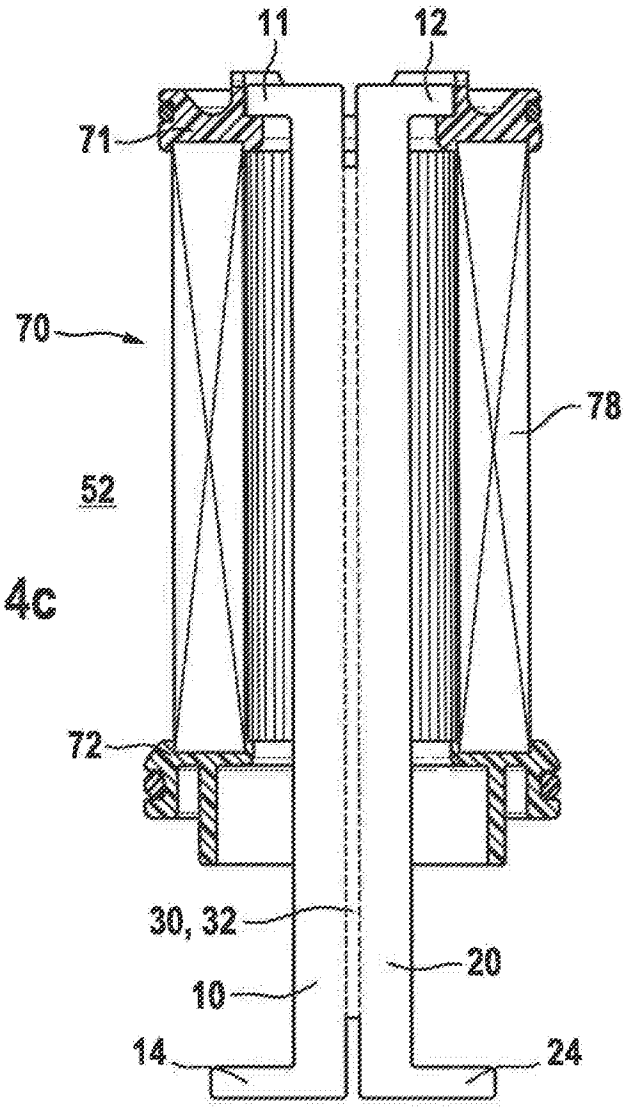

FIG. 4*c* shows removal tool 1 from FIG. 4*a* in removal state 52. For this purpose, the first arm was turned or pivoted about swivel joint 30 relative to second arm 20 by approximately 180° (see also the arrows in FIGS. 4*a*, 4*b*).

FIG. 4*d* shows a top view onto removal tool 1 from FIG. 4*c*. It is clearly apparent that, after first arm 10 has been turned relative to second arm 20 about swivel joint 30, the two hooks 11, 21 now point in opposite directions and thus engage behind edge 75 of first opening 73 of first end cap 71. The overall length of first and second hooks 11, 21 results from the sum of the two first distances D1.1+D1.2. Overall length D1.1+D1.2 is now greater than first diameter D3 of first opening 73 of first end cap 71.

Figure 5B:
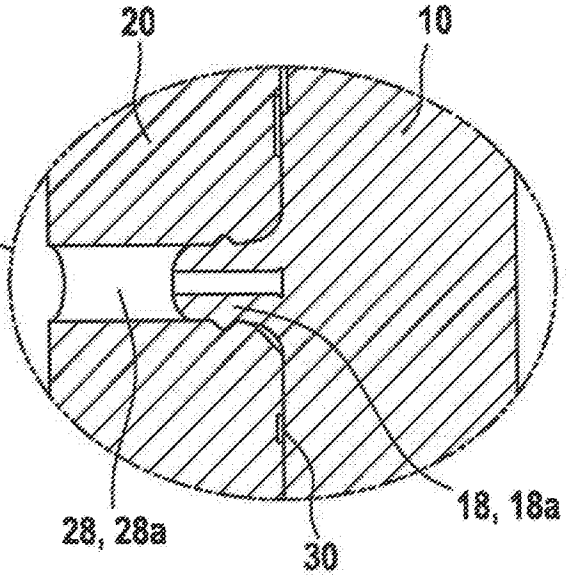
FIGS. 5*a*, 5*b* show a cross section and a detailed view of a cross section of the removal tool from FIGS. 3*a*, 3*b* in the removal state.
Figure 5A:
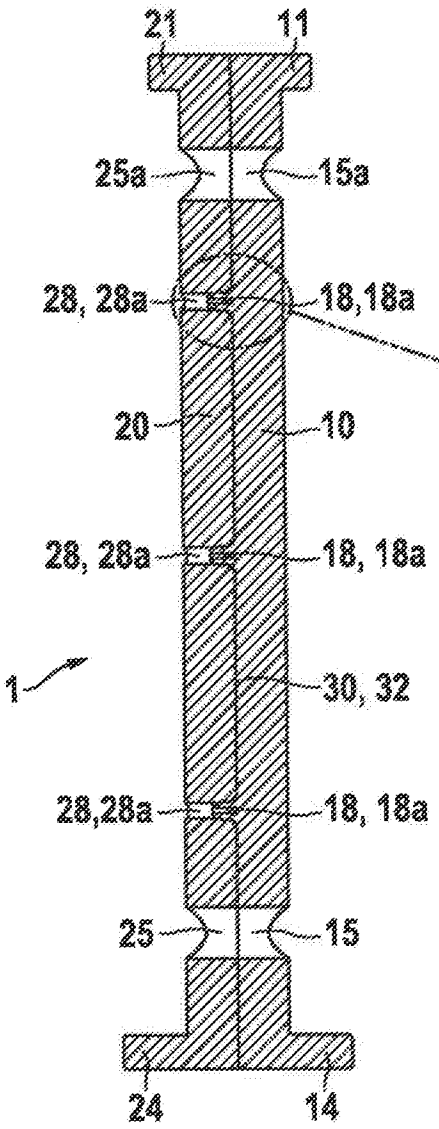

FIG. 5*a* shows a cross section through removal tool 1 from FIGS. 4*c* and 4*d*. It is clearly apparent how securing elements 18 configured as pins 18*a* engage in the corresponding mating elements 28 configured as grooves 28*a*, and thus stabilize removal tool 1. Moreover, it is apparent how the respective first operating openings 15, 15*a* are aligned with second operating openings 25, 25*a*.

FIG. 5*b* shows a detail from the section of removal tool 1 circled in FIG. 5*a*. It is apparent how securing element 18 configured as pin 18*a* engages in mating element 28 configured as groove 28*a*. Securing element 18 may have thickened areas on its outer side, which result in a larger diameter than the diameter of mating element 28. In this way, securing element 18 may be attached in mating element 28 in a force-fit or frictionally engaged manner. At the same time, a detachability is ensured, i.e., after the removal process of filter insert 70, removal tool 1 may be turned about swivel joint 30 from removal state 52 with little energy expenditure and moved back into insertion state 50. Securing elements 18 then detach from mating elements 28 in the process.

Figure 6B:
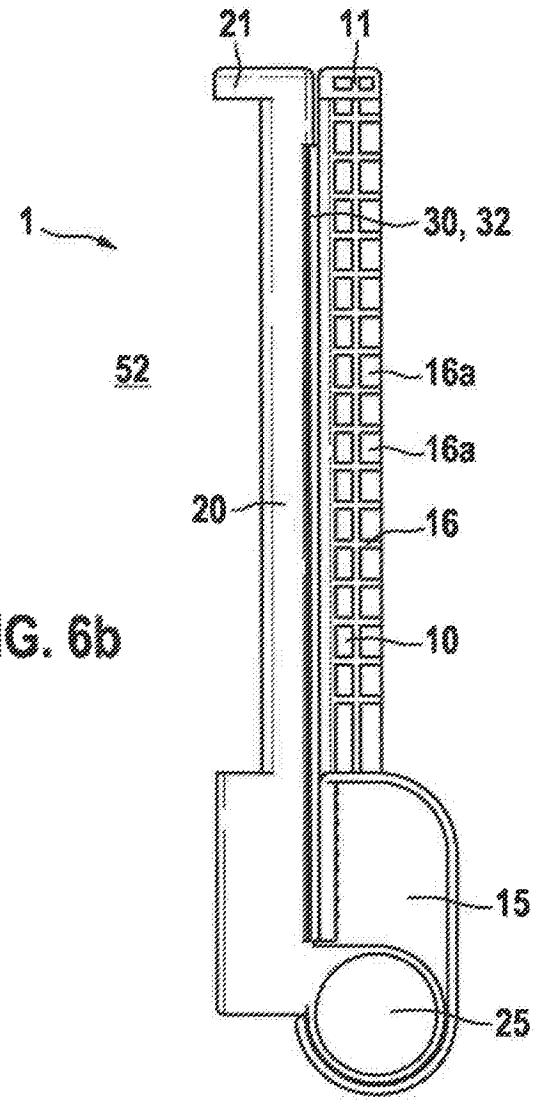
FIGS. 6*a*, 6*b* show front and rear views of a further exemplary embodiment of a removal tool in the removal state.
Figure 6A:
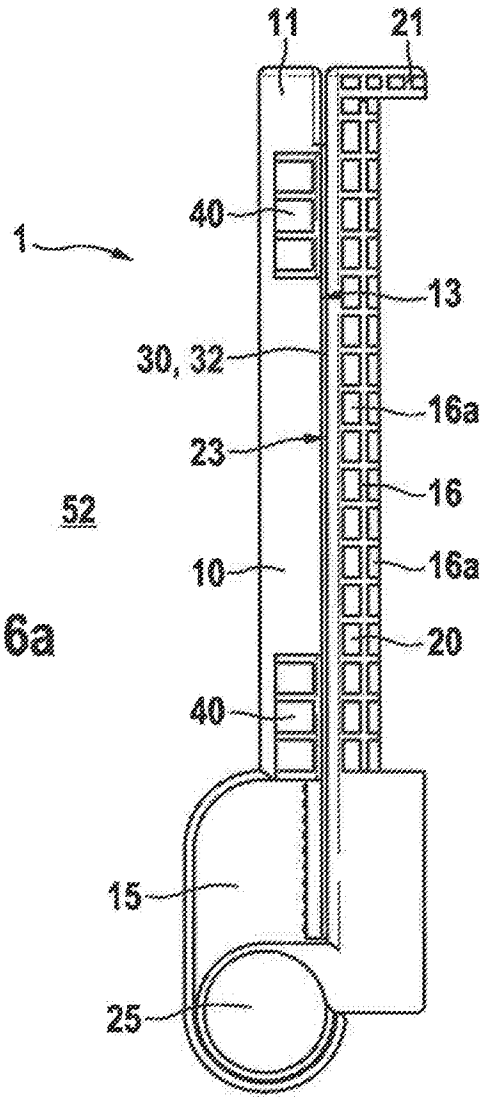

FIG. 6*a* shows a further specific embodiment of removal tool 1. Removal tool 1 is shown in removal state 52. In the shown exemplary embodiment, removal state 52 is already reached when first arm 10 is offset relative to second arm 20 by approximately 90°. To prevent further turning beyond the 90° mark, stops 40 or stop elements 40 are situated on first arm 10. In insertion state 50, which is not shown here, first hook 11 points approximately in the same direction as second hook 21. In this insertion state 50, first operating opening 15 and second operating opening 25 are also not collinearly situated, as in FIG. 6*a*, but they protrude from one another by approximately 90°. If removal tool 1 is now moved from insertion state 50, which is not shown here, into removal state 52 shown here, stop elements 40 prevent a rotation of first arm 11 relative to second arm 21 beyond a value of approximately 90°. The reason is that second arm 20 strikes against stop element 40 configured as stop 40. As a result of a haptic signal, an operator or a technician now knows that removal state 52 has been reached. The haptic signal is provided by the further rotation being blocked by second arm 20 striking against stop 40 or stop element 40 of first arm 10.

FIG. 6*b* shows removal tool 1 in a view turned by 180°.

In the two FIGS. 6*a* and 6*b*, ribs 16 serving as mechanical reinforcement as well as depressions or recesses 16*a* are each apparent, depressions or recesses 16*a* resulting in material and weight savings.

Figure 7B:
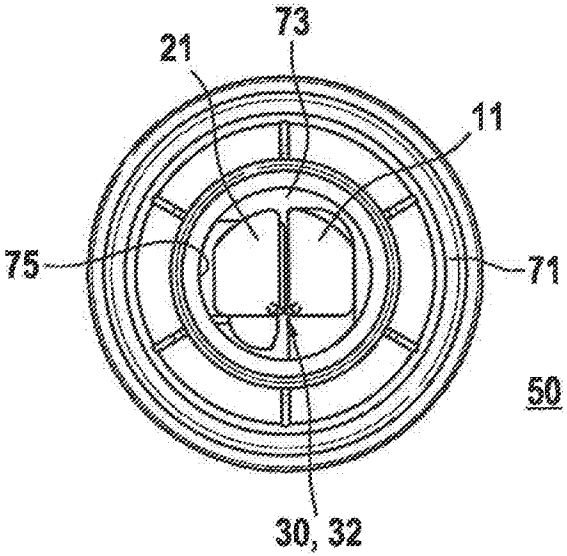
FIGS. 7*a* through 7*e* show schematic cross sections and top views of the removal tool from FIGS. 6*a*, 6*b* in the insertion state (FIGS. 7*a*, 7*b*) and in the removal state (FIGS. 7*c* through 7*e*).
Figure 7A:
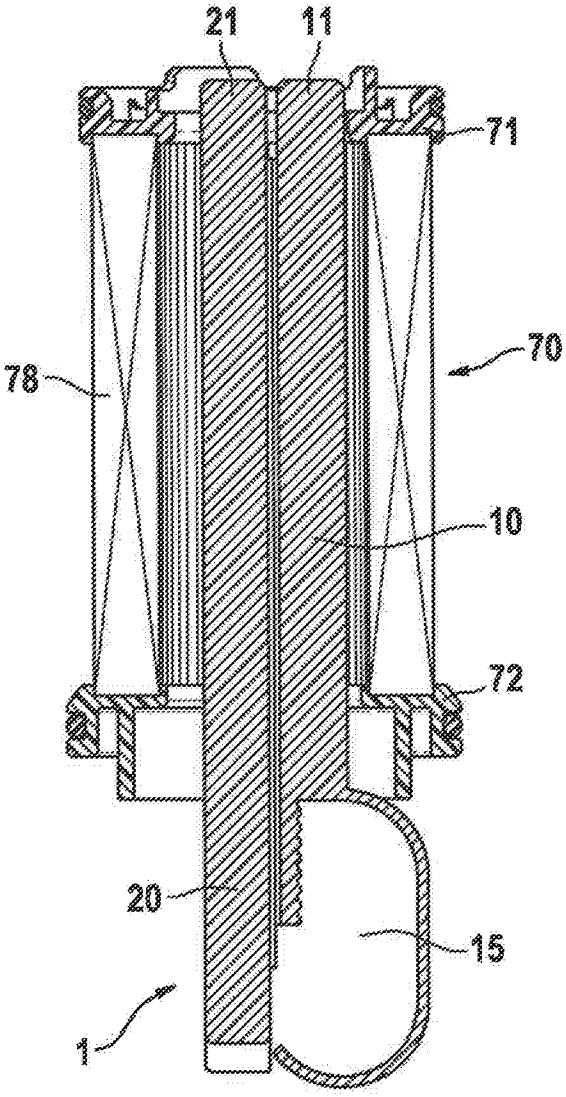

FIG. 7*a* shows the removal tool from FIG. 6*a* and FIG. 6*b* in insertion state 50.

Similarly to FIG. 4*b*, FIG. 7*b* shows a top view onto first hook 11 and second hook 21 of removal tool 1 in insertion state 50. It is apparent that first hook 11 and second hook 21 point in the same direction. In this way, it is possible to push the removal tool through the interior of filter insert 70 and through the two openings 73, 74 in the two end caps 71, 72.

Figure 7E:
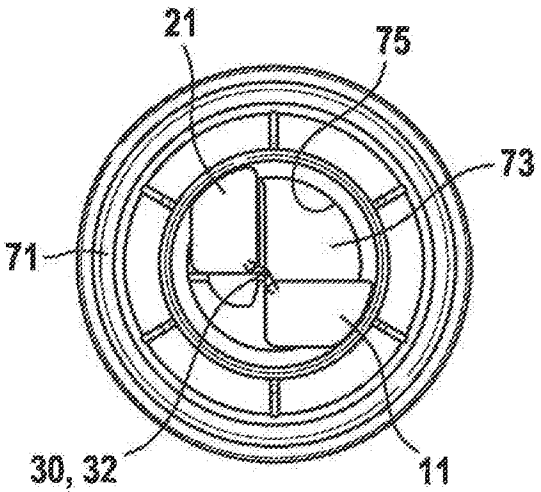
Figure 7D:
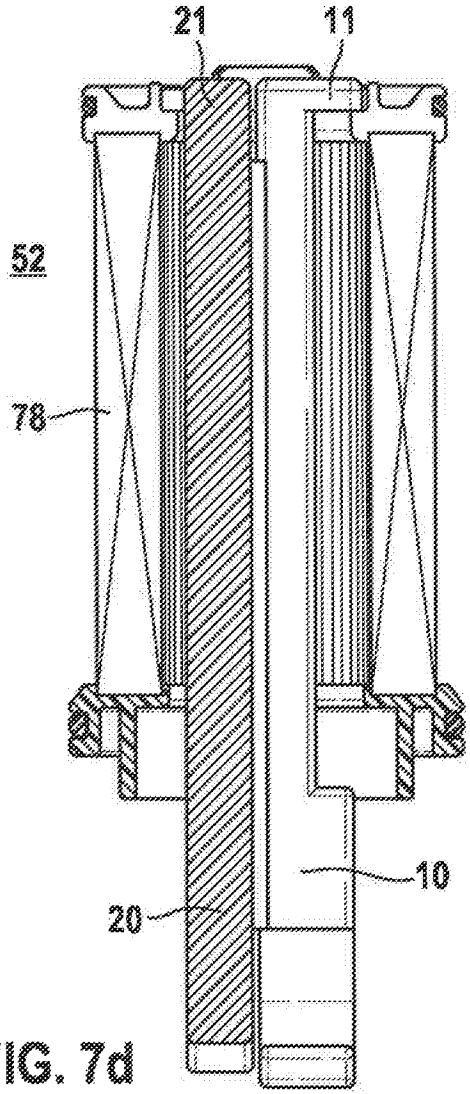
Figure 7C:
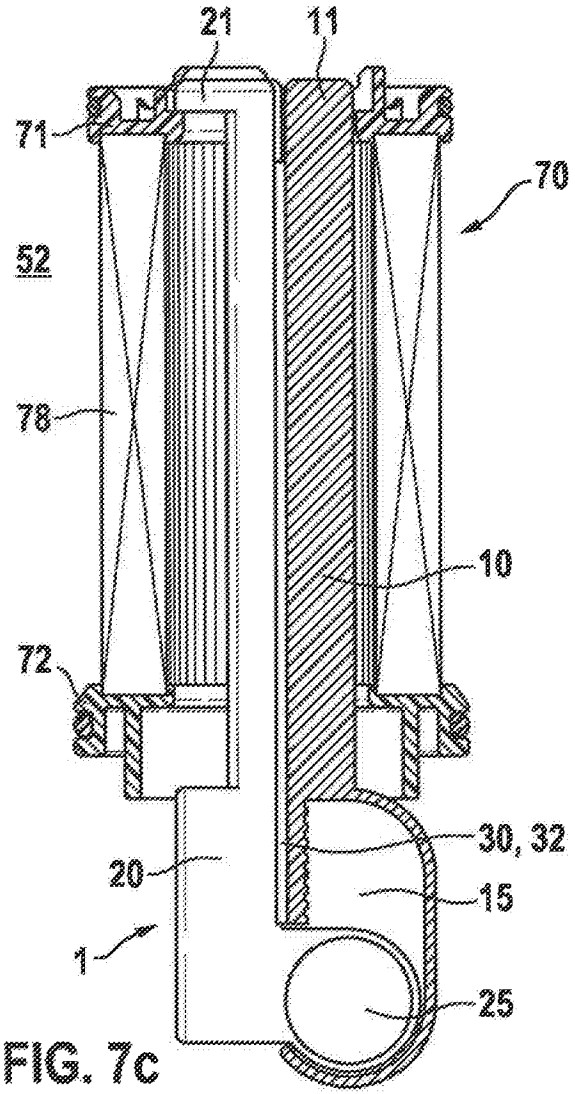

FIGS. 7*c* and 7*d* show removal tool 1 from FIG. 7*a* in removal state 52 in a cross section through a front view (FIG. 7*c*) and a view turned by 90° with respect to the front view (FIG. 7*d*). It is apparent in FIG. 7*c* that first operating opening 15 is now aligned with second operating opening 25. This creates a continuous through-channel, through which, for example, a screwdriver may be pushed. Removal state 52 is achieved by a rotation of first arm 10 relative to second arm 20 about swivel joint 30 by approximately 90°. The swivel joint may be configured as an integral joint 32 or as a hinge, for example.

FIG. 7*e* shows a top view onto first hook 11 and second hook 21 of removal tool 1 from FIGS. 7*c* and 7*d*. It is apparent that the two hooks 11, 21 now project from one another at an approximately right angle, i.e., enclose an angle of approximately 90° between one another. As a result, the two hooks 11, 21 engage behind edge 75 of first opening 73 of first end cap 71 of filter insert 70. In this way, filter insert 70 may be reliably moved out of its housing using removal tool 1.

Figure 8:
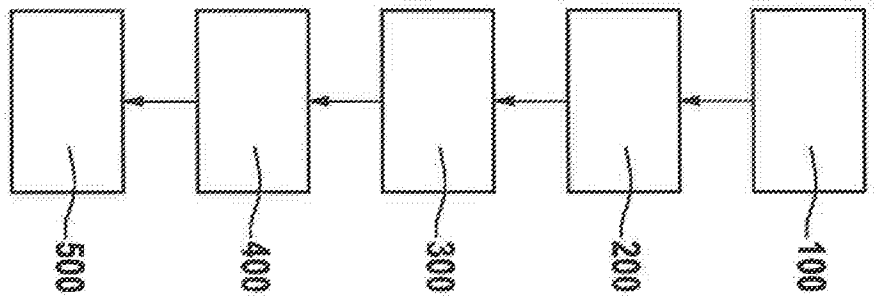
FIG. 8 shows steps of a method for removing a filter insert of a liquid filter.

FIG. 8 shows a method for removing a filter insert 70 of a liquid filter 90. As is shown, e.g., in FIGS. 2*a* through 2*c*, liquid filter 90 in the mounted state includes a housing 93, at least one liquid inlet 91, at least one liquid outlet 92, and filter insert 70. Filter insert 70 includes, e.g., a filter element 78 extending along a longitudinal axis A, a first end cap 71, and a second end cap 72, filter element 78 being situated between first end cap 71 and second end cap 72, as viewed along longitudinal axis A, first end cap 71 including a first channel-like opening 73, second end cap 72 including a second channel-like opening 74. The method includes the following steps:

a first step 100: providing a removal tool 1;

a second step 200: setting the removal tool into an insertion state 50, first hook 11 and second hook 21 in insertion state 50 having a first distance D1.1, D1.2 from swivel joint 30, 32 which is smaller than a first diameter D3 of first opening 73 and smaller than a second diameter D4 of second opening 74;

a third step 300: inserting removal tool 1 into filter insert 70 along an inserting direction 80 in such a way that hooks 11, 21 of removal tool 1 are at least fed through first opening 72, which may be fed through second opening 74 and completely through first opening 72;

a fourth step 400: setting removal tool 1 into a removal state 52 by turning the two arms 10, 20 of removal tool 1 relative to one another about swivel joint 30, 32, first hook 11 and second hook 21 in removal state 52 engaging behind an edge 75 of first opening 72 of first end cap 71; and a fifth step 500: displacing removal tool 1 counter to inserting direction 80 so that filter insert 70 is removed from housing 93 together with removal tool 1.

Shown removal tools 1 may be manufactured in a plastic injection molding process, for example. They may be manufactured from polypropylene, polyamide or polyethylene or at least partially include these materials.

The provided removal tool 1 is suitable for removing filter inserts 70 of liquid filters 90, for example for fuel filters or urea filters. Due to its properties, it is universally usable, i.e., for different types of filter inserts 70, easily manufacturable, cost-effective, and allows the reliable removal of filter inserts 70 from a housing 93 of an associated liquid filter 90.

What is claimed is:

1. A removal tool for a filter insert of a liquid filter, comprising:

a first arm having a first outer side; and a second arm having a second outer side;

wherein:

the first outer side extends along a first axis;

the second outer side extends along a second axis;

the first arm includes a first hook, which projects from the first arm essentially transversely to the first axis;

the second arm includes a second hook, which projects from the second arm essentially transversely to the second axis; and the first outer side and the second outer side are connected to one another with a swivel joint having a joint axis, wherein the removal tool is integral in one piece, wherein the swivel joint is configured as an integral joint or as a hinge.

2. The removal tool of claim 1, wherein the joint axis of the swivel joint extends in parallel to the first axis.

3. The removal tool of claim 1, wherein:

the removal tool, by turning the arms relative to each other, is settable into:

an insertion state in which the first hook and the second hook essentially point in a same direction and in which the first hook has a first distance from the swivel joint; and a removal state in which the first hook and the second hook have a second distance from each other; and the first distance is smaller than the second distance.

4. The removal tool of claim 3, wherein:

the removal tool is part of a system, wherein the system further includes the liquid filter, wherein the liquid filter in a mounted state, includes a housing, at least one liquid inlet, at least one liquid outlet, and the filter insert;

the filter insert includes a first end cap having a first channel opening, a second end cap having a second channel opening, and a filter that extends along a longitudinal axis and is situated between the first end cap and the second end cap as viewed along the longitudinal axis;

the first distance is smaller than a first diameter of the first channel opening; and the second distance is greater than the first diameter of the first channel opening.

5. The removal tool of claim 1, wherein the first arm or the second arm includes at least one stop for the other arm, so that a turning of the two arms about the swivel joint relative to one another by more than 100° is prevented.

6. The removal tool of claim 1, wherein a first operating end of the first arm has a channel-like first operating opening, and/or a second operating end of the second arm has a channel-like second operating opening.

7. The removal tool of claim 1, wherein:

the first arm, on an end situated opposite the first hook, includes a third hook, which projects from the first arm essentially transversely to the first axis;

the second arm, on an end situated opposite the second hook, includes a fourth hook, which projects from the second arm essentially transversely to the second axis; and at least one of the following:

the third hook has a greater length than the first hook, as viewed transversely to the first axis; and the fourth hook has a greater length than the second hook, as viewed transversely to the second axis.

8. The removal tool of claim 1, wherein the removal tool is part of a system, wherein the system further includes the liquid filter, wherein the liquid filter in a mounted state, includes a housing, at least one liquid inlet, at least one liquid outlet, and the filter insert.

9. The removal tool of claim 8, wherein the filter insert includes a first end cap having a first channel opening, a second end cap having a second channel opening, and a filter that extends along a longitudinal axis and is situated between the first end cap and the second end cap as viewed along the longitudinal axis.

10. The removal tool of claim 9, wherein the removal tool is configured to be:

set into an insertion state in which the first hook and the second hook have a first distance from the swivel joint, the first distance being smaller than a first diameter, which is of the first channel opening, and smaller than a second diameter, which is of the second channel opening; and inserted into the filter insert along an inserting direction so that the hooks are fed completely through the second opening and through the first opening.

11. The removal tool of claim 10, wherein the removal tool is configured such that, after the feeding of the hooks completely through the second opening and through the first openings, the removal tool is settable into a removal state by turning the first and second arms relative to each another about the swivel joint with the first hook and the second hook engaging behind an edge of the first channel opening, thereby causing that the filter insert would be removed from the housing together with the removal tool by a subsequent displacement of the removal tool counter to the inserting direction.

12. The removal tool of claim 1, wherein the swivel joint extends over a majority of the length between the first arm and the second arm.

13. The removal tool of claim 1, wherein the removal tool is made from a plastic material.

14. A removal tool for a filter insert of a liquid filter, comprising:

a first arm having a first outer side; and a second arm having a second outer side;

wherein:

the first outer side extends along a first axis;

the second outer side extends along a second axis;

the first arm includes a first hook, which projects from the first arm essentially transversely to the first axis;

the second arm includes a second hook, which projects from the second arm essentially transversely to the second axis; and the first outer side and the second outer side are connected to one another with a swivel joint having a joint axis, wherein:

the removal tool, by turning the arms relative to each other, is settable into:

an insertion state in which the first hook and the second hook essentially point in a same direction and in which the first hook has a first distance from the swivel joint; and a removal state in which the first hook and the second hook have a second distance from each other; and the first distance is smaller than the second distance, wherein a securing element is situated on the first arm, wherein a mating element complementary to the securing element is situated on the second arm, and wherein in the removal state, the securing element is coupled to the mating element.

15. The removal tool of claim 14, wherein the securing element is configured as a pin, and the mating element is configured as a groove in which the pin is accommodated in the removal state, or the mating element is configured as a pin, and the securing element is configured as a groove in which the pin is accommodated in the removal state.

* * * * *